US006213574B1

(12) United States Patent
Pierce

(10) Patent No.: US 6,213,574 B1
(45) Date of Patent: Apr. 10, 2001

(54) BASEBALL DISPENSER

(76) Inventor: Dan Pierce, 1534 N. Moorepark Rd. #167, Thousand Oaks, CA (US) 91360

( * ) Notice: Subject to any disclaimer, the term of this patent is extended or adjusted under 35 U.S.C. 154(b) by 0 days.

(21) Appl. No.: 09/131,070

(22) Filed: Aug. 7, 1998

(51) Int. Cl.[7] ..... A47F 1/00; A47B 51/00; B65B 21/02; B65D 85/00

(52) U.S. Cl. ..... 312/35; 312/312; 414/417; 206/315.9

(58) Field of Search ..... 414/490, 417; 312/312, 35; 206/315.9

(56) References Cited

U.S. PATENT DOCUMENTS 3,494,503 * 2/1970 Kingsley ..... 312/312
4,244,410 * 1/1981 Silverman ..... 312/35
5,040,675 * 8/1991 Cleveland et al. ..... 206/315.9

* cited by examiner

*Primary Examiner*—Robert P Olszewski
*Assistant Examiner*—Bryan Jaketic
(74) *Attorney, Agent, or Firm*—Goldstein & Canino

(57) ABSTRACT

A baseball dispenser for storing and dispensing a balls, comprising a cylindrical container which has an interior sized to hold a large supply of baseballs, softballs, and the like, and an opening at its top for receiving balls into the interior thereof. The baseball dispenser has a pair of handles secured to the upper end of the container and a pair of wheels rotatably mounted to the lower end thereof for facilitating easy transportation across the surface of the ground. One or more support columns extend vertically from the bottom of the container, wherein a compression spring is disposed about each of the support columns. A circular platform is vertically slidably disposed within the container and is engaged with the support columns such that the compression springs are constrained axially between the bottom of the container and the platform. The support columns serve to guide the platform as it travels in a vertical path along the interior of the container, and at the same time, the compression springs serve to automatically elevate the platform to a level at which the balls located on the top can readily be grasped for use as the balls are removed from the container.

1 Claim, 3 Drawing Sheets

BASEBALL DISPENSER

BACKGROUND OF THE INVENTION

This invention relates to a baseball dispenser. More particularly, the invention relates to a baseball dispenser which employs a container for holding a large supply of baseballs or softballs and a pair or wheels attached thereto for facilitating easy transportation across the surface of the playing field. Further, the invention relates to a baseball dispenser which is designed to automatically elevate the balls retained therein to a level at which the balls located on the top can be easily grasped by a pitcher or coach during batting practice.

Baseball and softball players spend a great deal of time practicing and developing their bat swinging technique by swinging at balls that are thrown at a high speed. This form of training requires a pitcher or coach to repetitiously throw a large number of balls from the pitcher's mound to the catcher behind the home plate. Thus, it is desirable to have a baseball dispenser that is capable of holding a large supply of balls, and at the same time, helping pitchers and coaches to carry out batting practices by enabling retrieval of balls without having to stoop or bend over before each pitch.

Several references uncovered in the prior art describe various devices for dispensing playing balls. For example, U.S. Pat. No. 4,798,319 to James discloses a portable tennis ball caddy formed to vertically orient a plurality of spring biased balls towards an exit opening. While these units mentioned above may be suitable for the particular purpose employed, or for general use, they would not be as suitable for the purposes of the present invention as disclosed hereafter.

SUMMARY OF THE INVENTION

It is an object of the invention to provide a baseball dispenser which helps pitchers and coaches to carry out batting practice without having to stoop or bend over to pick up a baseball before each pitch.

It is another object of the invention to provide a baseball dispenser which employs a cylindrical container for holding a large supply of baseballs or softballs, and a spring-biased platform vertically disposed within the container for automatically elevating the contained balls to a level at which the balls located on the top can be easily grasped, thereby eliminating the need to stoop and bend over to pick up a ball before each pitch.

It is yet another object of the invention to provide a baseball dispenser which utilizes support columns and compression springs for guiding the platform as it travels in a vertical path along the interior of the container and, at the same time, provide a stable horizontal support to the platform so that the platform will not wobble during transportation of the dispenser.

It is a further object of the invention to provide a baseball dispenser which can be used for storage of baseballs, softballs, and the like.

The invention is a baseball dispenser for storing and dispensing a balls, comprising a cylindrical container which has an interior sized to hold a large supply of baseballs, softballs, and the like, and an opening at its top for receiving balls into the interior thereof. The baseball dispenser has a pair of handles secured to the upper end of the container and a pair of wheels rotatably mounted to the lower end thereof for facilitating easy transportation across the surface of the ground. One or more support columns extend vertically from the bottom of the container, wherein a compression spring is disposed about each of the support columns. A circular platform is vertically slidably disposed within the container and is engaged with the support columns such that the compression springs are constrained axially between the bottom of the container and the platform. The support columns serve to guide the platform as it travels in a vertical path along the interior of the container, and at the same time, the compression springs serve to automatically elevate the platform to a level at which the balls located on the top can readily be grasped for use as the balls are removed from the container.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
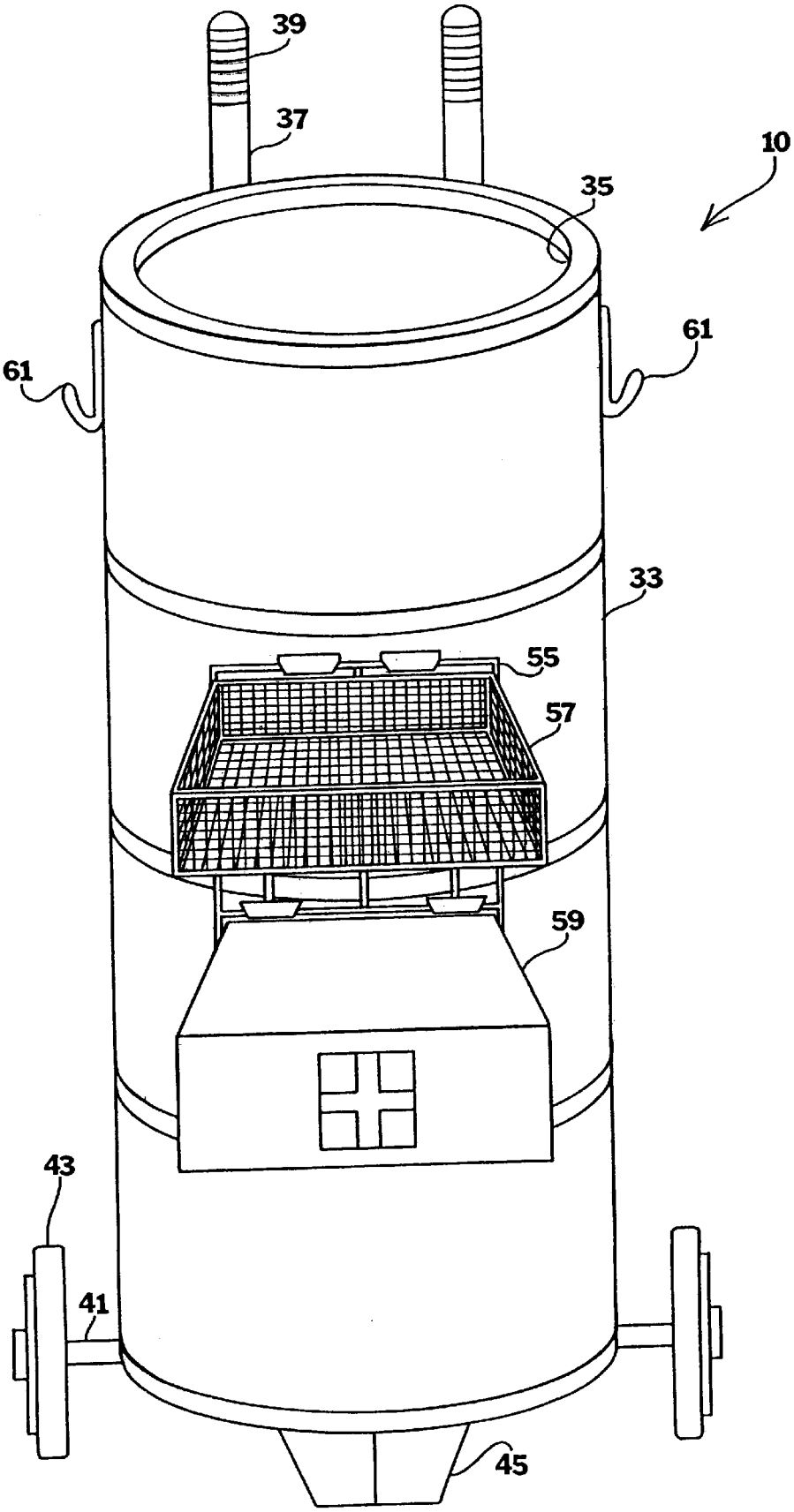
FIG. 1 is a diagrammatic perspective view of a preferred embodiment of a baseball dispenser in accordance with the principles of the present invention.

FIG. 1 illustrates a preferred embodiment of a baseball dispenser 10 in accordance with the principles of the present invention. As will be seen in the following paragraphs, the baseball dispenser 10 of the present invention is designed to conveniently bring a large supply of baseballs or softballs to within easy reach of a pitcher or coach during batting practice so that the pitcher or coach can pick up the balls contained therein without having to stoop or bend over.

The baseball dispenser 10 includes a cylindrical container 33 having an interior which is sized to hold a large number of baseballs or softballs and an opening 35 at its top for receiving balls into the interior thereof. A pair of handles 37 are secured to the container 33 to facilitate manipulation of the baseball dispenser 10, which are provided with ribbed hand grips 39 to allow a user to firmly grab the handles 37 during transportation of the dispenser. The baseball dispenser 10 is provided with an axle shaft 41 secured to the lower end thereof and a pair of wheels 43 rotatably mounted to the opposite ends of the axle shaft to facilitate easy transportation across the surface of the ground. A support stand 45 extends downwardly from the front edge of the container 33 for enabling the baseball dispenser 10 to be maintained in a vertical storage position.

Figure 2:
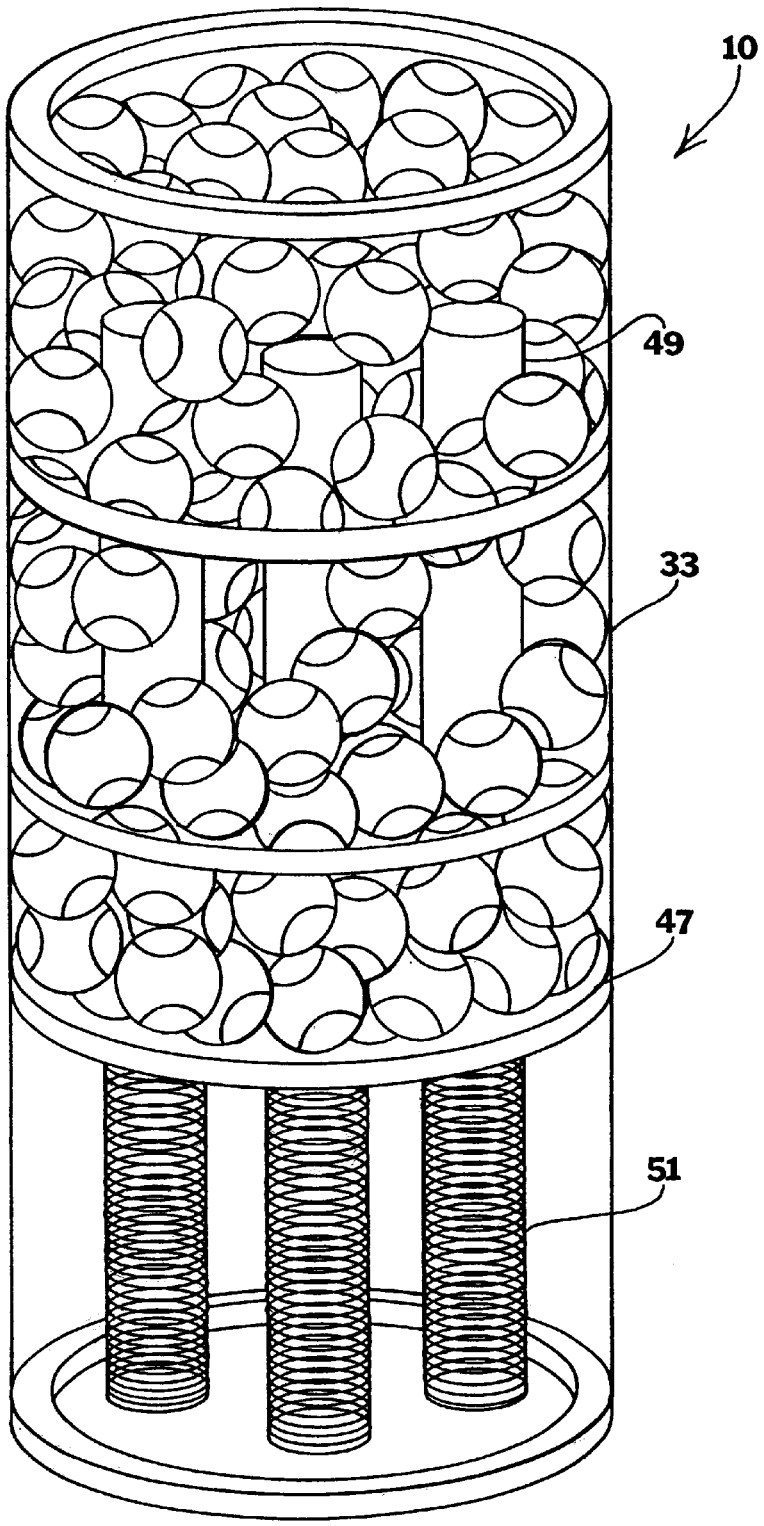
FIG. 2 is a diagrammatic perspective view of the baseball dispenser, with parts broken away, illustrating a platform within the container which is shown lowered in a contracted position.

As seen by referring to FIG. 2, the baseball dispenser 10 further comprises a platform 47 having a circular shape which is sized to coincide with the interior configuration of the container 33. The platform 47 is vertically slidably disposed within the interior of the cylindrical container 33 and is moveable between expanded and contracted positions under the influence of the baseball retained therein and of opposing upward bias force. The platform 47 is upward biased to push the platform upwardly in the container to a level at which the balls located on the top can readily be grasped for use.

Figure 3:
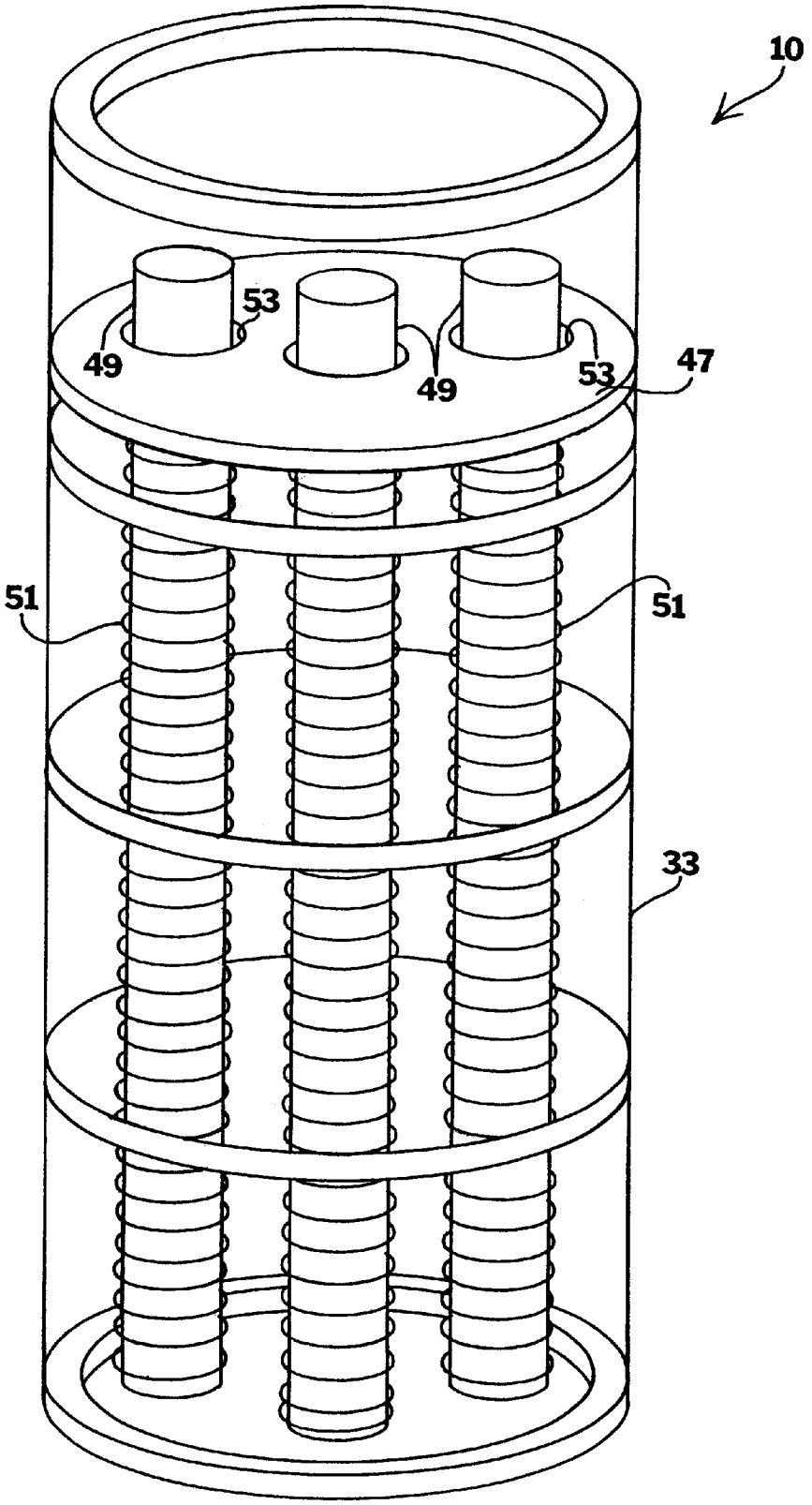
FIG. 3 is a diagrammatic perspective view of the baseball dispenser, with parts broken away, illustrating the platform within the container raised to an expanded position.

The means for upwardly biasing the platform 47 in the container may be carried out in a number of ways. Referring to FIG. 3, in the preferred embodiment, one or more support columns 49 extend vertically from the bottom of the container and a compression spring 51 is disposed about each of the support columns 49 for biasing the platform 47 vertically upward. The platform 47 is provided with bores 53 through which the support columns 49 extend. The platform 47 is engaged with the support columns 49 such that the compression springs 51 are constrained axially between the bottom of the container 33 and the circular platform 47. The support columns 49 serve to guide the platform 47 as it travels in a vertical path along the interior of the container and, at the same time, provide a stable horizontal support to the platform so that the platform will not wobble during transportation of the dispenser.

The operation of the baseball dispenser 10 will now be described. The platform 47 is upward biased such that when the container is vacant, the platform will rise to a predetermined level, as depicted in FIG. 2. When a large number of baseballs are placed within the container 33, the platform 47 will gradually be displaced vertically downward, as the weight of the contained baseballs is sufficient to overcome the upward bias force of the compression springs, as depicted in FIG. 2. The compression springs 51 serves to automatically elevate the contained balls, as the balls are removed from the platform. In this manner, the balls located at the top are always within an easy reach of a pitcher or coach so as to eliminate the need to stoop or bend over to pick up a ball before each pitch.

Referring back to FIG. 1, the preferred embodiment of the present invention contemplates affixing one or more grid wall support members 55 to the exterior sides of the container 33 for releasably mounting a wire basket 57 and a first aid kit 59. In addition, a plurality of accessory hooks 61 is affixed to the container 33 near the top for conveniently hanging uniforms, hats, and the like.

Many specific details contained in the above description merely illustrate some preferred embodiments and should not be construed as a limitation on the scope of the invention. Many other variations are possible.

What is claimed is:

1. A ball dispenser for storing and dispensing balls, comprising:

a) a container having an interior sized to hold a plurality of balls and an opening at its top for receiving balls into the interior thereof, said container having a closed bottom;

b) a platform disposed within said interior of the container for supporting balls, said platform moveable between an expanded position wherein said platform is elevated to a level within the container at which the platform can be easily reached by a user and a contracted position wherein said platform is displaced vertically downward a predetermined distance from said expanded position;

c) biasing means having an upward bias force for supporting said platform, said biasing means operatively engaged with said platform such that said expanded position is maintained when the container is vacant and said contracted position is maintained when a plurality of balls are placed within the container, said biasing means adapted to automatically push the platform upwardly in the container to a height at which the balls can readily be grasped for use, in response to the balls being removed therefrom; and d) said biasing means comprising a plurality of support columns extending vertically from the bottom of the container for guiding the platform as it travels in a vertical path along the interior of the container, and a compression spring disposed about each of said support columns for biasing the platform vertically upward, and wherein the platform is provided with a plurality of bores through which said support columns extend, the platform engaged with said support columns such that said compression springs are constrained axially between the bottom of the container and the platform.

* * * * *